United States Patent [19]

Schechter et al.

[11] 4,004,743

[45] Jan. 25, 1977

[54] METHODS AND APPARATUS FOR WRAPPING A WIRE ON A TERMINAL

[75] Inventors: Robert Schechter, Peabody, Mass.; Douglas W. Winslade, Kingston, N.H.

[73] Assignee: Western Electric Company, Inc., New York, N.Y.

[22] Filed: Oct. 29, 1974

[21] Appl. No.: 518,537

[52] U.S. Cl. ..... 242/7.03; 140/124; 242/7.06

[51] Int. Cl.[2] ..... H01B 13/00; B21F 15/00

[58] Field of Search ..... 242/7.06, 7.17, 7.18, 242/7.03; 29/33 M; 140/124

[56] References Cited

UNITED STATES PATENTS

| | | | |
|---|---|---|---|
| 2,525,093 | 10/1950 | Cahenzli | 140/124 |
| 2,746,124 | 5/1956 | Belek | 242/7.17 X |
| 3,536,271 | 10/1970 | Petree | 242/7.06 |
| 3,618,641 | 11/1971 | Hannify | 242/7.17 X |

*Primary Examiner*—Stanley N. Gilreath
*Assistant Examiner*—John M. Jillions
*Attorney, Agent, or Firm*—D. J. Kirk; D. D. Bosben

[57] ABSTRACT

A wire wrap bit has a rotatable drive member with an axial bore to receive a terminal to be wrapped, and a ridge extending longitudinally along the outer periphery thereof. A hollow rotatable outer member having a longitudinal opening therein to receive the ridge is positioned circumferentially of the drive member. A wire is inserted in a channel formed by the ridge and an edge of the longitudinal opening and is releasably clamped therebetween upon rotation of the drive member. Continued rotation of the drive member causes the wire to be withdrawn from the channel and tightly wrapped on the terminal due to the tension on the wire resulting from the rotational clamping action.

17 Claims, 4 Drawing Figures

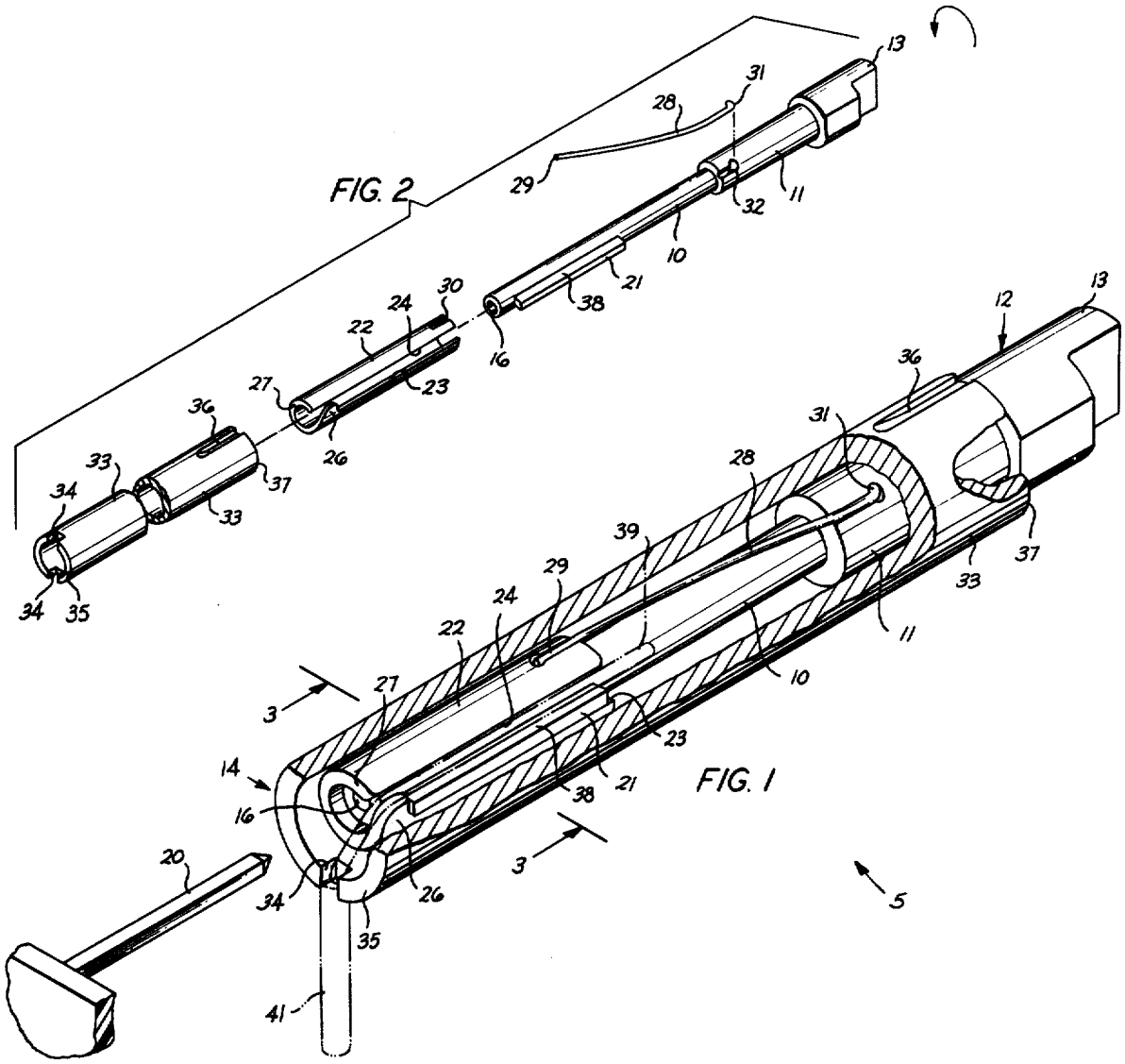
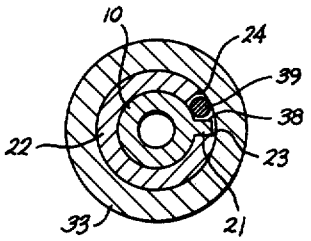
FIG. 3A
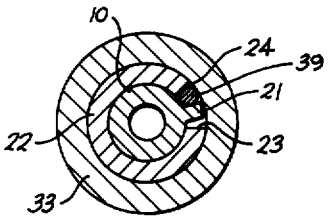
FIG. 3B

METHODS AND APPARATUS FOR WRAPPING A WIRE ON A TERMINAL

BACKGROUND OF THE INVENTION

1. Field of the Invention

This invention relates to methods and apparatus for wrapping strands on articles, and more particularly, to methods and an improved wire wrap bit for wrapping the ends of electrically conductive wires on metallic terminals.

2. Description of the Prior Art

Wire wrapping tools conventionally include a rotary driver for rotating a bit which is disposed within a stationary sleeve member. The bit has a central axial recess at one end to receive a terminal and a radially offset longitudinal channel or slot to receive the bare wire or shiner to be wrapped about the terminal. The wire outside the channel is anchored to the sleeve member and upon operation of the rotary driver, the bit is rotated and the wire is withdrawn from the channel as it is wrapped about the terminal.

In order to form a desirable tight wrap, the channel has a diameter only slightly greater than the diameter of the wire. This causes tension in the wire as it is withdrawn from the channel due to the frictional drag on the wire as it is being wrapped. Because of the close tolerances between the wire and the channel surface, such a prior art wire wrap bit is normally limited to accepting only a single gauge of wire and poses substantial difficulty to the operator when inserting such a wire to be wrapped into the opening of the channel. In addition, with extensive use, the channel tends to enlarge due to wear thereby producing a loose fit between the wire and the channel surface, reducing the frictional drag. This tends to decrease the tension on the wire as it is being wrapped, resulting in unacceptable loose wire wraps.

SUMMARY OF THE INVENTION

The instant invention solves the foregoing problems with an improved method for wrapping a strand on an article comprising the steps of: (1) rotating a bit which has an axial cavity therein to receive the article and which further has a radially offset longitudinal channel for receiving the strand; and (2) releasably clamping the strand in the channel as the strand is simultaneously withdrawn from the channel clamping action and wrapped about the article.

Apparatus to implement such a method comprises a rotatable outer member and a drive member which is rotationally disposed within the outer member and has an axial cavity to receive the article on which the stand is to be wrapped. A longitudinal ridge on the drive member extends radially outwardly into an opening in the outer member to simultaneously rotatively clamp the strand inserted therebetween and rotate the outer member to cause the strand to be withdrawn from the clamping action and wrapped about the article upon rotation of the drive member.

An additional feature of the instant invention is a means for biasing the rotatable outer member and the drive member to such relative positions that a maximum opening between the longitudinal ridge of the drive member and an edge of the opening in the outer member is provided in the unoperated position. This is accomplished by providing a spring member connected between the rotatable drive member and the rotatable outer member.

Thus, the instant invention provides consistently tight and repeatable wire wraps due to the controlled tension that is maintained on the wire as it is being withdrawn from the channel and helically wrapped on the terminal. This results from the rotational clamping force exerted by the ridge which is urged firmly against the full length of the wire in the channel as long as the wire is in the channel.

Advantageously, the channel defined by the longitudinal ridge and the one edge of the opening in the outer member prior to the rotation of the drive member, is of such dimensions as to receive one of a plurality of different wire gauge sizes. In addition, this wide opening facilitates the insertion or placement of wires into the longitudinal channel for the tolerance is not critical as the clamping action will always take place upon rotation of the drive member.

Another advantage is that the individual parts of the bit (i.e., rotatable outer member, rotatable drive member, spring member, etc.) are separable and may be replaced on an individual basis. Therefore, simple replacement of the worn or defective part will preclude the junking of the entire expensive wire wrap bit.

Still another advantage is the fact that any wear, due to extended use, of the longitudinal ridge or the edge of the rotatable outer member will be compensated due to the rotational clamping action. Therefore, acceptable wire wraps will be obtained even when there has been substantial wear of the component parts.

A further advantage is that the clamping action provides controlled tensioning of the wire which results in more uniform wraps and desirable high pull-off strengths.

BRIEF DESCRIPTION OF THE DRAWINGS

FIG. 1 is a perspective view of an exemplary embodiment of the instant inventive wire wrap bit.

FIG. 2 is an exploded perspective view of the illustrative embodiment of the instant wire wrap bit.

FIG. 3A is a cross-sectional view of the instant wire wrap bit taken through plane 3—3 of FIG. 1 prior to rotation of the rotatable drive member.

FIG. 3B is a cross-sectional view of the instant wire wrap bit taken through plane 3—3 of FIG. 1 during rotation of the rotatable drive member.

DETAILED DESCRIPTION OF THE PREFERRED EMBODIMENT

An exemplary embodiment of the instant wire wrap bit generally referred to as numeral 5, is illustrated in FIG. 1 with additional detail shown in the exploded view of FIG. 2. A rotatable cylindrical drive member 10 is shown having an enlarged portion 11 at the driven end indicated generally as 12 in FIG. 1 with a tongue section 13. The tongue section may be inserted into a suitable power driver apparatus such as an air or an electrically actuated wire wrapping tool (not shown) for rotating the drive member, for example, in a counterclockwise direction (indicated by the arrow in FIG. 2). At a wrapping end 14 of the rotatable cylindrical drive member 10 is an axial bore 16 to receive a terminal 20 (FIG. 1) to be wrapped. The rotatable cylindrical drive member 10 additionally has a longitudinal ridge 21 that extends along the periphery thereof. A rotatable outer sleeve-like cylinder 22, having a C shaped cross section, is positioned circumferentially of, and thus coaxially with, the drive member 10 and has a longitudinal opening or slot defined by first and second arcuately spaced edges 23 and 24 respectively.

Additionally, the first arcuately spaced edge 23 has a wire-engaging shoulder or lip 26 at its forward end 27. A spring 28, made of music wire or the like, having a first end 29 is pressed or welded into a first indentation 30 in the rotatable outer cylinder 22 and a second end 31 which is also pressed or welded into a second indentation 32 in the enlarged portion 11 of cylindrical drive member 10.

A stationary tubular sleeve member or housing 33 is mounted circumferentially to both the rotatable cylindrical drive member 10 and the rotatable outer cylinder 22. The tubular sleeve member 33 has notches 34-34 in a first end 35 and a depression 36 in a second end 37 which is engaged by the housing of the driven apparatus (not shown) to prevent the tubular sleeve member from rotating during the wire wrapping operation.

In the unoperated or rest position (see FIG. 3A), portions of the longitudinal ridge 21 and the first arcuately spaced edge 23 are in contact due to the bias provided by the spring 28. A longitudinal channel is formed between a portion of the second arcuately spaced edge 24 of the rotatable outer cylinder 22 and an opposed portion of a side 38 of the longitudinal ridge 21, wherey the inner drive member 10 and the outer C-shaped cylinder 22 are rotatable relative to one another within limits defined by the ridge 21 and the edges 23 and 24 of the cylinder.

In operation, a portion of a shiner or stripped end 39 of a wire 41, shown in phantom in FIG. 1, is inserted into the longitudinal channel formed between the second arcuately spaced edge 24 of the rotatable outer cylinder 22 and the side 38 of the longitudinal ridge 21. When fully inserted, the shiner 39 is bent at approximately a right angle over shoulder 26 of the cylinder 22 and a portion of the shiner is anchored in notch 34. The wire wrap bit 5 is then placed over terminal 20 with the terminal extended into the axial bore 16. The power driver means (not shown) is activated causing the rotatable cylindrical drive member 10 to rotate in a counterclockwise direction. The rotatable outer cylinder 22 is inhibited from rotating by shiner 39 which is anchored or retained in notch 34 and is in contact with the shoulder 26 of the rotatable outer cylinder 22. In other words, the tension on shiner 39 causes the shiner to bear against shoulder 26 and resist rotation of cylinder 22. This overcomes the action of spring 28 and permits releasable clamping of the shiner 39 between opposed portions of edge 24 of the cylinder 22 and ridge 21 of the drive member 10. Accordingly, as the rotatable cylindrical drive member 10 rotates, the side 38 of the longitudinal ridge 21 will bear against the shiner 39 of wire 41 (see FIG. 3B) to clamp the shiner 39 between the first arcuately spaced edge 24 of the rotatable outer cylinder 22 and the side 38 of the longitudinal ridge 21 of the rotatable cylindrical drive member 10.

The rotational driving force is transmitted from the longitudinal ridge 21 through the shiner 39 to the rotatable outer cylinder 22 causing that cylinder to rotate. As the drive member 10 rotates, the shiner 39 is held stationary at slot 34 while that portion of the shiner clamped between edge 24 and ridge 21 is rotated around terminal 20. Each rotation of the drive member 10 wraps one revolution of the shiner 39 about the terminal 20 thereby requiring a portion of the shiner to be pulled from between edge 24 and ridge 21. As the shiner 39 is clamped, it is pulled under tension thereby insuring a tight wrap about the terminal 20. Once the shiner 39 of wire 41 has been fully withdrawn from the channel, the rotatable outer cylinder 22 will again have edge 23 in contact with the longitudinal ridge 21 due to the biasing action of spring 28 resulting in the channel being fully opened. The power driver means may be shut off, the wire wrapping bit 5 removed from terminal 20 and the next shiner 39 to be wrapped inserted in the channel.

It should be clear from the foregoing that the unique rotational clamping action on the shiner 39 which occurs during the wrapping operation, due to the shiner being captured between side 38 of longitudinal ridge 21 and the second arcuately spaced edge 24 of rotatable outer cylinder 22, results in a substantially constant clamping force on the shiner. This clamping force results in frictional forces on the shiner 39 which could not have been obtained with prior art wire wrap bits. This clamping action assists in providing controlled tension on the shiner 39 due to the fact that the shiner is being held tightly at two locations as it is being withdrawn from one of the locations and wrapped about the terminal 20. The two locations are (1) the notch 34 and (2) the channel in which the shiner 39 is clamped during the wire wrapping operation. Although prior art wire wrap bits anchor the shiner in a notch to hold the shiner tightly in a first position, there is no positive holding or clamping action in a second position from which the shiner is withdrawn. Thus, the prior art bits rely on close tolerances of channels of fixed dimensions to provide a frictional drag as the shiner is withdrawn from the fixed dimensioned channel. The wires are difficult to insert in the channel due to the close tolerances and wear in the channel or the shiner itself resulted in low tension on the wire causing loose wire wraps.

The instant wire wrapping bit provides a uniform clamping action regardless of the wire gauge used or the ordinary wear of the component parts, resulting in wraps having high pull-off strengths with concomitant excellent physical and electrical connections. These benefits accrue in the instant wire wrap bit due to the fact that no matter what the gauge of the wire 41, the longitudinal ridge 21 will continue to rotate and clamp the shiner 39 against the spaced edge 24 of the rotatable outer cylinder 22. Thus, wires having a plurality of different gauges can be sequentially or alternatively wrapped using the same bit while achieving acceptable wraps for all gauges. Furthermore, the generous channel opening in the unoperated position facilitates the ease of insertion of the shiner 39 by the operator, for the clamping action only takes place after the shiner is put in the channel and the bit rotated.

In a specific working embodiment of the invention in which the wire wrap bit 5 is capable of wrapping 22, 24, 26 or 28 gauge wire, the overall length of the bit is 3.1 inches. The rotatable cylindrical drive member 10 has a diameter of 0.088 inches and is 2.5 inches in length with the axial bore 16 having a diameter or 0.067 inches and a length of 0.875 inches. The longitudinal ridge 21 is 1.125 inches long and approximately 0.067 inches thick and starts 0.1 inch from the forward end 27 of the rotatable cylindrical drive member 10. The rotatable outer cylinder 22 is 1.312 inches in length and has an inner diameter of 0.106 inches and an outer diameter of 0.156 inches. The shoulder 26 has a length of approximately 0.125 inches with a height of about 0.063 inches and the distance between the top of the shoulder and the second arcuately spaced edge 24 is 0.031 inches. The spring 28 is 0.028 inch diameter music wire and approximately 0.965 inches in length. The stationary sleeve member 33 is of a standard size with an inner diameter of sufficient size to allow free movement of the rotating parts of the wire wrap bit.

Although the above-referred to specific embodiment was designed to wrap 22 to 28 gauge wire, it should be clear that bits arranged to accept other gauges of wire could be constructed using the instant inventive concepts. Also, it is evident that the component parts of the wire wrap bit are individually replaceable with precludes the necessity of replacing an expensive bit when one part is worn.

What is claimed is:

1. A method for wrapping a wire on a terminal, comprising the steps of:

inserting a first portion of the wire into a channel formed by a longitudinal ridge on the periphery of a cylindrical drive member and one edge of a longitudinal opening in a hollow cylinder mounted circumferential to the drive member and into which opening the ridge projects;

releasably clamping the first wire portion between the longitudinal ridge and the edge of the longitudinal opening in the hollow cylinder upon rotation of the cylindrical drive member;

retaining a second portion of the wire adjacent the first wire portion against movement;

further rotating the drive member relative to the second wire portion to transmit rotational motion through the releasably clamped first wire portion to the hollow cylinder causing the releasably clamped first wire portion to be withdrawn from the channel, under tension, and wrapped about the terminal; and biasing the hollow cylinder to a postion wherein the longitudinal ridge contacts another edge of the longitudinal opening in the hollow cylinder upon withdrawal of the releasably clamped first wire portion from the channel.

2. The method for wrapping a wire on a terminal as set forth in claim 1 comprising the additional step of:

anchoring the wire outside the channel to a stationary member spaced from the drive member and outer cylinder prior to the rotation thereof.

3. An apparatus for wrapping a wire on a terminal, comprising:

a rotatable cylindrical drive member having an axial bore to receive the terminal to be wrapped;

a hollow rotatable outer cylinder circumferential of said drive member and having a longitudinal opening therein defined by a pair of arcuately spaced edges to receive a portion of the wire to be wrapped;

a longitudinal ridge extending along the outer periphery of said cylindrical drive member and projecting into the longitudinal opening in said outer cylinder to clamp the wire to be wrapped against one of the spaced edges of said outer cylinder during rotation of said drive member and said outer cylinder relative to the wire, which rotation simultaneously causes the wire portion in the opening to be withdrawn from the opening under uniform tension and wrapped tightly on the terminal; and means for biasing the longitudinal ridge of said cylindrical drive member against the other of the pair of spaced edges of said outer cylinder upon completion of the wrapping of the wire portion on the terminal.

4. An apparatus for securely wrapping a wire on a terminal, comprising:

a rotatable cylindrical drive member having an axial bore to receive the terminal to be wrapped;

a hollow rotatable outer cylinder circumferential of said drive member and having a longitudinal opening therein defined by first and second arcuately spaced edges;

a stationary tubular housing mounted about said outer cylinder;

a shoulder on a forward end of the first arcuately spaced edge of said outer cylinder;

a longitudinal ridge extending along the outer periphery of said drive member and projecting into the longitudinal opening in said outer cylinder to form a wire-receiving channel between said ridge and the second arcuately spaced edge of said outer cylinder, a portion of the wire being insertable over said shoulder and into the channel, and being releasably clamped in the channel between said ridge and the second arcuately spaced edge and withdrawn from the channel and wrapped on the terminal upon rotation of said drive member and said outer cylinder; and a spring member connecting said drive member and said outer cylinder to bias said outer cylinder to a first position wherein said ridge is biased against the first arcuately spaced edge of said outer cylinder upon withdrawal of the wire portion from the wire-receiving channel and past said shoulder.

5. An apparatus as recited in claim 4, which further comprises:

means for anchoring a portion of the wire to said housing.

6. A method of wrapping a strand on an article, which comprises the steps of:

inserting a first portion of the strand between clamping portions of first and second rotatable members;

initially rotating the first rotatable member relative to the second rotatable member to releasably clamp the first strand portion between the clamping portions of the members;

retaining a second portion of the strand adjacent the releasably clamped first strand portion against movement; and further rotating the first rotatable member to cause rotation of the second rotatable member in unison with the first rotatable member relative to the retained second strand portion to cause withdrawal of the releasably clamped first strand portion from between the clamping portions of the members under tension and to wrap the first strand portion on the article.

7. A method of wrapping a strand on an article, as recited in claim 6, which further comprises the step of:

biasing at least one of the rotatable members about its axis of rotation to move the clamping portion of the member into arcuately spaced open relationship with respect to the clamping portion of the other member for the insertion of the first strand portion therebetween.

8. A method of wrapping a strand on an article, as recited in claim 6, which further comprises the step of:

engaging the second rotatable member with the strand to resist rotation of the second rotatable member with the first rotatable member, to cause the releasable clamping of the first strand portion between the clamping portions of the members.

9. A method of wrapping a strand on an article, as recited in claim 8, which further comprises the steps of:

disengaging the strand from the second rotatable member as the wrapping of the first strand portion on the article is completed; and biasing the second rotatable member about its axis of rotation to move the clamping portion of the second rotatable member into arcuately spaced open relationship with respect to the clamping portion of the first rotatable member for the insertion of a portion of another strand between the clamping portions.

10. A method of wrapping a strand on an article, as recited in claim 6, wherein the strand is a wire and the article is a terminal, and which further comprises the steps of:

biasing the second rotatable member about its axis of rotation to move the clamping portion of the member into arcuately spaced open relationship with respect to the clamping portion of the first rotatable member for the insertion of a first portion of the wire therebetween;

anchoring a second portion of the wire which is adjacent the first portion of the wire inserted between the clamping portions of the first and second rotatable members, against movement, to cause the withdrawal of the releasably clamped first portion of the wire from between the clamping portions of the members as the members are rotated in unison;

engaging the second rotatable member with the anchored wire to resist rotation of the second rotatable member with the first rotatable member, to cause the releasable clamping of the first wire portion between the clamping portions of the members;

disengaging the wire from the second rotatable member as the wrapping of the first wire portion on the terminal is completed; and biasing the second rotatable member about its axis of rotation to move the clamping portion of the second rotatable member into open relationship with respect to the clamping portion of the first rotatable member for the insertion of a portion of another wire between the clamping portions.

11. An apparatus for wrapping a strand on an article, comprising:

first and second coaxial members rotatable relative to one another within limits; and opposed clamping portions on said first and second rotatable members defining a strand-receiving channel;

said clamping portion on said first member being a surface of an opening in said first member, and said clamping portion on said second member being a surface of a ridge on said second member projecting radially into the opening in said first member; and said first and second members being relatively rotatable to cause the opposed clamping portions of said members to releasably clamp a first portion of the strand which has been inserted therebetween in the strand-receiving channel defined thereby, and being subsequently rotatable in unison relative to a second portion of the strand to cause withdrawal of the releasably clamped first strand portion from between the clamping portions of the members under tension and wrapping of the first strand portion on the article.

12. An apparatus for wrapping a strand on an article, as recited in claim 11, which further comprises:

spring means for biasing at least one of said rotatable members about its axis of rotation relative to the other of said rotatable members to move said clamping portion of said one rotatable member into arcuately spaced open relationship with respect to said clamping portion of said other rotatable member.

13. An apparatus for wrapping a strand on an article, comprising:

first and second coaxial members rotatable relative to one another within limits;

clamping portions on said first and second rotatable members defining a strand-receiving channel;

said first and second members being relatively rotatable to cause the clamping portions of said members to releasably clamp a first portion of the strand which has been inserted therebetween in the strand-receiving channel defined thereby, and being subsequently rotatable in unison relative to a second portion of the strand to cause withdrawal of the releasably clamped first strand portion from between the clamping portions of the members under tension and wrapping of the first strand portion on the article; and biasing means connected between said first and second rotatable members for biasing at least one of said rotatable members about its axis of rotation relative to the other of said rotatable members to move said clamping portion of said one rotatable member into arcuately spaced open relationship with respect to said clamping portion of said other rotatable member.

14. An apparatus for wrapping a strand on an article, comprising:

first and second coaxial members rotatable relative to one another within limits, one of said rotatable members being a cylindrical inner drive member and the other of said rotatable members being an outer sleeve-like member mounted coaxially with and circumferentially of said inner drive member;

clamping portions on said first and second rotatable members defining a strand-receiving channel; and A shoulder portion on said outer rotatable member engageable by the strand to resist rotation of said outer member with said drive member, thereby to preclude initial rotation of said outer rotatable member with said drive member and to cause the clamping portions of said members to releasably clamp a first portion of the strand which has been inserted therebetween in the strand-receiving channel defined thereby;

said shoulder thereafter causing the clamping portions of said members to releasably clamp the first portion of the strand as the members are rotated in unison relative to a second portion of the strand, to cause withdrawal of the releasably clamped first strand portion from between the clamping portions of the members under tension and wrapping of the first strand portion on the article.

15. An apparatus for wrapping a strand on an article, as recited in claim 14, in which:

said outer member is generally C-shaped in cross-section and includes spaced edges which define an opening therebetween, one of said edges also defining the strand clamping portion of said outer member; and said inner drive member includes a longitudinally extending ridge projecting radially into the opening defined by the edges of said C-shaped outer member, said ridge including a side which defines the strand clamping portion of said drive member.

16. An apparatus for wrapping a strand on an article, as recited in claim 15, which further comprises:

a stationary sleeve member in which said rotatable members are mounted; and means on said sleeve member for anchoring the strand against movement to cause the withdrawal of the releasably clamped portion of the strand from between the clamping portions of said rotatable members as said members are rotated in unison.

17. An apparatus for wrapping a strand on an article, as recited in claim 15, wherein the strand is a wire and the article is a terminal, and in which:

said inner drive member includes an axial bore to receive the terminal; and said biasing means is connected between said inner drive member and said outer C-shaped member to bias the clamping portions of said members into arcuately spaced open relationship for the reception of a portion of the wire in the channel defined by said members.

* * * * *